US005492168A

United States Patent [19]

Hemsath

[11] Patent Number: 5,492,168

[45] Date of Patent: Feb. 20, 1996

[54] HIGH CONVECTIVE HEAT TRANSFER IMMERSION HEATER/COOLER

[75] Inventor: Klaus H. Hemsath, Toledo, Ohio

[73] Assignee: Indugas, Inc., Toledo, Ohio

[21] Appl. No.: 324,224

[22] Filed: Oct. 17, 1994

Related U.S. Application Data

[63] Continuation-in-part of Ser. No. 276,399, Jul. 18, 1994, abandoned.

[51] Int. Cl.[6] ..... F25B 29/00; C21D 1/64

[52] U.S. Cl. ..... 165/47; 165/134.1; 165/132; 165/142; 165/908; 266/120; 266/131; 266/259

[58] Field of Search ..... 165/47, 132, 142, 165/134.1, 908; 266/120, 130, 131, 132, 141, 259

[56] References Cited

U.S. PATENT DOCUMENTS

| | | | |
|---|---|---|---|
| 2,650,799 | 9/1953 | Fritzberg | 165/142 |
| 2,752,147 | 6/1956 | Besselman et al. | 266/132 |
| 2,942,858 | 6/1960 | Stoneburner | 165/142 |
| 3,441,452 | 4/1969 | Westeren | 266/131 |
| 3,684,263 | 8/1972 | Genrich | 266/131 |
| 4,225,121 | 9/1980 | Meyer et al. | 266/259 |
| 4,487,398 | 12/1984 | Lincoln et al. | 266/120 |
| 4,693,015 | 9/1987 | Hemsath et al. . | |
| 4,830,610 | 5/1989 | Hemsath . | |
| 4,889,182 | 12/1989 | Kösters | 165/134.1 |
| 4,891,008 | 1/1990 | Hemsath . | |
| 5,082,055 | 1/1992 | Hemsath . | |

*Primary Examiner*—John K. Ford
*Attorney, Agent, or Firm*—Frank J. Nawalanic

[57] ABSTRACT

A heat exchanger includes a long, thin-shelled heat transfer tube closed at one end and secured at the other end to a manifold collar which has an exhaust tube extending from the center thereof and a manifold housing extending from the collar side opposite that from which the heat transfer tube extends. A plurality of longitudinally extending distributor tubes extend from the heat transfer tube through the collar in fluid communication with a sealed manifold chamber and a plurality of orifices spaced at longitudinal increments along the length of each distributor tube permits the wind mass in the manifold chamber to exit the orifices as high speed, free-standing gas jets for impingement against the interior of the heat transfer tube so that the heat transfer tube acts either as a heat source or as a heat sink. An annular manifold plate spaced slightly from the collar defines a cooling space between the manifold plate and collar and orifices within the manifold plate permit a small portion of the wind mass to enter into the cooling space for heat transfer cooling of the collar while the collar also shields the manifold plate from heat within the heat transfer tube. A bleed path between exhaust tube and collar allows the gas in the cooling space to flow through the exhaust tube to maintain the manifold collar at an even temperature gradient.

13 Claims, 4 Drawing Sheets

HIGH CONVECTIVE HEAT TRANSFER IMMERSION HEATER/COOLER

This is a continuation-in-part of my prior U.S. patent application Ser. No. 276,399, filed Jul. 18, 1994 now abandoned.

This invention relates generally to equipment for use in the industrial heat treat art and more particularly to a gas heat exchanger.

The invention is particularly applicable to and will be described with specific reference to an immersion cooler for use in a quench tank of an industrial heat treating furnace. However, the invention has broader application and can also be used as a gas heat exchanger for heating and in another context, the invention can be used in general as a seal arrangement for use in gas heat exchangers.

INCORPORATION BY REFERENCE

My prior United States patents listed below are incorporated by reference herein and made a part hereof:

1.) U.S. Pat. No. 4,693,015 issued Sep. 15, 1987 entitled "Direct Fired Cylinder Dryer";

2.) U.S. Pat. No. 4,830,610, issued Jan. 2, 1990 entitled "High Temperature Convection Furnace";

3.) U.S. Pat. No. 4,891,008 issued Jan. 2, 1990 entitled "High Temperature Convection Furnace"; and 4.) U.S. Pat. No. 5,082,055 issued Jan. 21, 1992 entitled "Gas Fired Radiant Tube Heater".

The above patents are incorporated by reference so that certain details and concepts known in the art need not be described in further detail herein. The subject matter disclosed in my prior patents does not form part of the present invention.

BACKGROUND

It is common in the heat treat furnace art to equip a heat treat furnace with an integral quench. The quench is a quench tank situated beneath the furnace and contains a liquid quench medium. The quench medium is typically a liquid salt, water or oil bath into which the heated work is placed for rapid cooling to meet time-temperature heat treat process requirements. The heat from the work is given off to the liquid in the quench tank. Some type of heat sink has to be provided in the tank to return or maintain the liquid bath at its ambient temperature. This is typically accomplished by placing coils containing coolant within the bath. The coolant within the coils receives heat from the liquid in the quench tank and then passes through a heat exchanger located outside of the quench tank where the coolant is cooled before returning to the inlet end of the coils in the quench tank. This is an effective and efficient cooler. It is somewhat expensive because of the cost of the heat exchanger necessary for the cooling arrangement to function as a closed loop. Also, the cooling coils are directly exposed to the quenchant. Should the coils develop a leak (which can happen on the basis of thermal expansion-contraction considerations) the cooling gas can leak directly into the quenchant. It is also possible, in the prior art closed loop system, for the coolant gas to pick up oil or hydrocarbons from the fan compressor and some hydrocarbons could conceivably leak into the quenchant vis-a-vis the coil portions within the tank. The quench tank is sealed and should the quenchant be water, steam is given off which can react with oil or hydrocarbons to produce an explosion.

In any gas heat exchanger, there is a need to produce a simple, inexpensive but efficient seal which is able to withstand the thermal stresses imposed on the heat exchange by the changing thermal stress gradients caused by the hot and cold gases within the heat exchanger. There are far too many heat exchanger designs in the heat treat field to discuss prior art seal arrangement in this background section. One type of seal arrangement that can be generally described uses a spring biased seal to maintain the hot heat exchanger components against the cold heat exchanger part where the two components generally meet i.e., the manifold and return duct. In time, any spring biasing seal will wear and leak. Still another seal arrangement uses a water jacket adjacent an elastomer seal which is an expensive construction.

SUMMARY OF THE INVENTION

It is a principal object of the invention to provide a unitary, heat exchanger structure capable of withstanding thermal stresses resulting from fluids at different temperatures therein.

This object along with other features of the invention is achieved in a heat exchanger using cold pressurized air to cool gases and liquids which includes a cylindrical heat transfer tube having a closed end and an open end. Secured gas tight to the open end of the heat transfer tube is a manifold and the manifold has an annular collar adjacent the open end of the tube and an annular manifold plate parallel and adjacent to the collar to define an annular cooling space therebetween. Secured to the collar and surrounding the manifold plate is a manifold housing and the collar and manifold plate each has a plurality of aligned distributor tube openings therethrough. A plurality of small diameter distributor tubes extend through the tube openings and are gas tight connected to the manifold plate. Each tube has orifice openings along its length directed radially outwardly to face the interior of the heat transfer tube so that a cooling gas can impinge the heat transfer tube by jet streams emanating from the orifices. An insulating annular ring having a plurality of aligned distributor tube openings is provided within the heat transfer tube adjacent to the collar. Thus, the manifold plate which is exposed to the cooling gas within the manifold housing is protected from direct exposure to heat from within the heat transfer tube by the insulating ring and the collar. The manifold plate has multiple orifices extending therethrough for impinging cold air from the manifold housing against the collar within the cooling space to cool the collar whereby the collar is maintained at a cooler temperature than what would otherwise be possible to reduce heat transfer from the heated cooling gas within the heat transfer tube and reduce the thermal gradient to which the manifold plate would otherwise be subjected to. An exhaust tube extends through the central openings of the insulating ring, the collar and the manifold plate for exhausting heated cooling gas from the heat transfer tube. The central openings of the collar and the ring are larger than the exhaust tube to define a leakage path therebetween for leaking cooling gas from the cooling space past the insulating ring into the interior of the heat transfer tube. An insulating sleeve is secured to the exhaust tube for insulating the collar and the manifold from the heated cooling gases exhausted through the exhaust tube. The insulated structure as described provides an insulated, shielded arrangement in which an insignificant portion of the cooling gas is utilized to cool the shielding member of the arrangement thus obviating the need for pressure biased seals otherwise required to seal the heat exchanger to compensate for fluids at different temperatures within the heat exchanger which temperatures vary during operation of the heat exchanger.

In accordance with another specific object of the invention, a gas immersion cooler for a quench tank of a heat treat furnace is provided which includes a cylindrical heat transfer tube having a closed axial end and an open axial end. An annular manifold collar is secured on one side in a gas tight manner to the heat transfer tubes open end and the collar has the central exhaust opening and a plurality of distributor tube openings with the center of each distributor tube opening located at equal circumferential increments about an imaginary circle concentric with the exhaust opening. A gas exhaust tube longitudinally extends within the exhaust opening and a distributor tube within each tube opening extends longitudinally in the opposite direction from the exhaust tube to be positioned within and closely adjacent the interior of the heat transfer tube so that the distributor tube's orifices, as disclosed above, can develop free standing gas jet streams which impinge the interior surface of the heat transfer tube. A manifold housing is secured in a gas tight manner to the exhaust tube on the opposite side of the collar from which the heat transfer tube is affixed and the manifold housing has an air inlet. A fan arrangement outside the quench tank develops a pressurized wind mass at ambient temperature. An inlet conduit in fluid communication with the fan and the manifold inlet extends into the quench tank for providing the pressurized wind mass to the distributor tubes and an outlet conduit in fluid communication with the exhaust tube extends outside the quench tank for exhausting the wind mass from the immersion cooler after it has impacted the interior of the heat transfer tube thus providing a sealed unit eliminating the presence of cooling coils directly exposed to the quenchant in the quench tank which could otherwise leak oil or hydrocarbons into the tank.

In accordance with still another aspect of the invention, a thermal seal arrangement is provided for an industrial furnace gas heat exchanger which includes a plurality of elongated distributor tubes having a plurality of orifices spaced along the length thereof for discharging jet streams of a gaseous heat exchange medium in convective heat transfer contact with a heat transfer surface. Each distributor tube is fixed to an annular manifold collar having a central exhaust opening and the seal arrangement includes, a manifold housing affixed in a gas tight manner to the manifold collar on the side opposite from that which the distributor tubes extend and has an inlet opening for receiving a coolant gas. An exhaust tube slightly less in diameter than the collar's central opening extends through the manifold housing and is sealed in a gas tight manner to the housing to define between the manifold housing and the exhaust tube a sealed manifold chamber which is in fluid communication with the inlets of the distributor tubes supported in the manifold collar. A manifold plate is provided within the manifold chamber and the manifold plate and collar have a plurality of openings through which said distributor tubes extend with the tubes gas tight secured to the manifold plate. The manifold plate is secured at its outer edge to the manifold housing and at its inner edge to the exhaust tube to define a cooling space within the manifold chamber extending between the manifold plate and the manifold collar. The manifold plate has a plurality of bleed orifices extending therethrough for permitting a small portion of the cooling gas in the manifold housing to impinge the manifold collar to maintain the manifold collar at even thermal temperatures while shielding the manifold plate from heat. The coolant within the cooling space subsequently passes through the opening between the manifold collar and the exhaust tube prior to being exhausted through the exhaust tube.

In accordance with another aspect of the invention, the heat exchanger described includes at least one annular tube support plate spaced at a longitudinal distance within the heat transfer tube. The tube support plate has an inside diameter approximately equal to that of the exhaust tube and an outside diameter slightly less than the inside diameter of the heat transfer tube. Also, the tube support plate further includes a plurality of distributor tube openings aligned with the collar distributor tube openings for receiving the distributor tubes so that the tube support plate's outer edge restrains movement of the distributor tubes during operation of the heat exchanger.

It is another object of the invention to provide an immersion cooler or a heat exchanger which is simple and economical to construct.

It is another object of the invention to provide a gas immersion cooler or a gas heat exchanger which provides high, convective heat transfer rates.

Yet another object of the invention is to provide a gas immersion cooler or heat exchanger where the heat exchange gas is carried by a tube within a tube to minimize any leakage of the gas outside the heat exchanger.

It is another object of the invention to provide a unitary heat exchanger which compensates for thermal expansion and contraction resulting from fluids at different temperatures therein by utilizing an insulated shield arrangement therein in combination with a cooling gas stream flow.

It is yet another object of the invention to provide a gas immersion cooler or a gas heat exchanger having an integral gas-tight sealed construction while also providing a mechanism for sealing the unit to compensate for thermal expansion and contraction without the necessity of any water jackets or movable spring biased sealing arrangements.

Still yet another object of the invention is to provide in general a gas cooled, sealing arrangement for use in any industrial heat treat heat exchanger which arrangement uses a welded gas-tight construction obviating the need for any spring or movable sealing mechanisms.

These and other objects of the invention will become apparent to those skilled in the art upon reading and understanding the detailed description of the invention set forth below.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 3 is a longitudinally sectioned view of the immersion cooler of the present invention taken along lines 3—3 of FIG. 2;

FIG. 6 is a larger view of the manifold arrangement shown in FIG. 3.

DETAILED DESCRIPTION OF THE INVENTION

Figure 1:
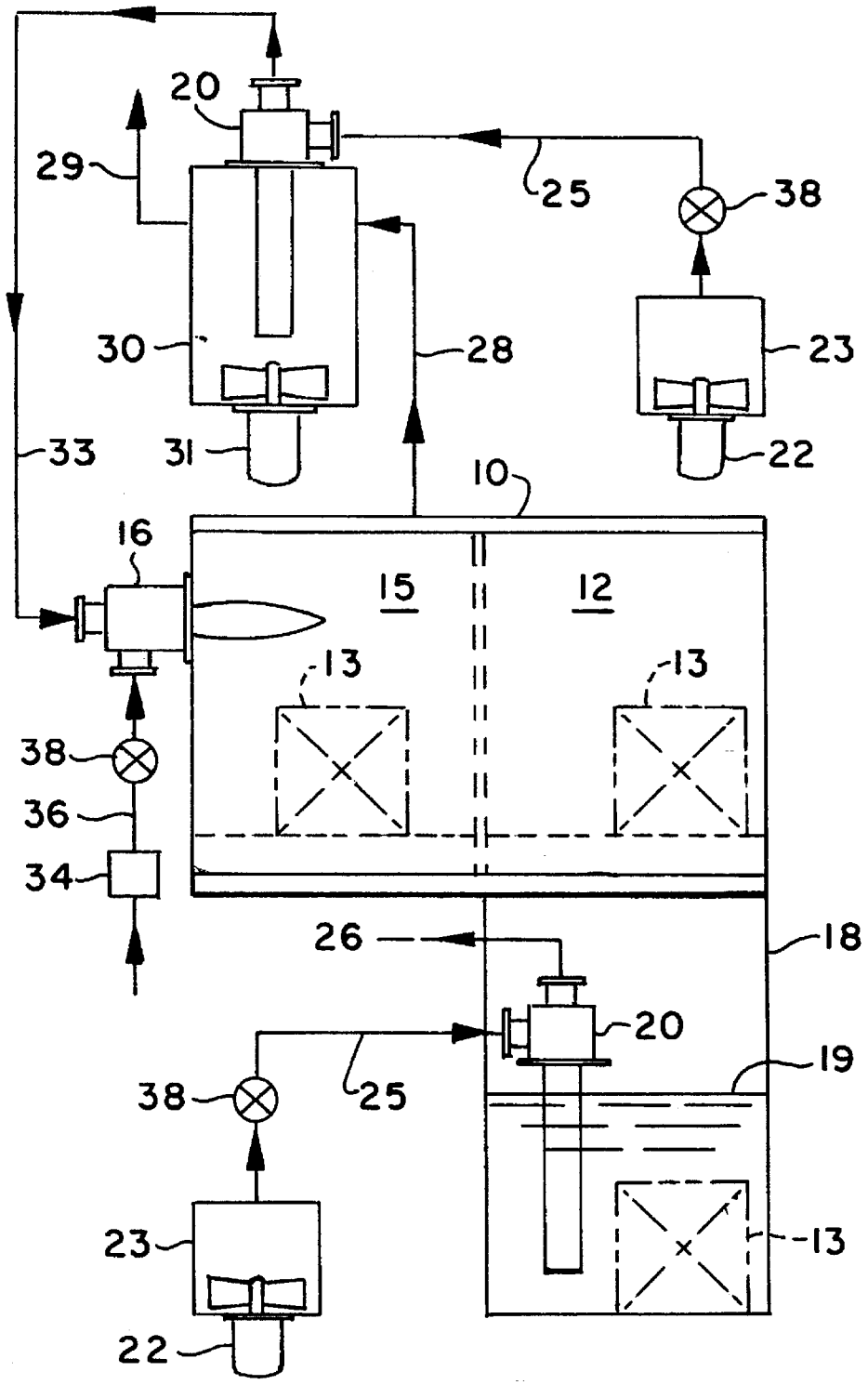
FIG. 1 is a schematic view of a gas fired heat treating furnace with an immersion cooler for cooling and a heat exchanger for heating purposes.

Referring now to the drawings wherein the showings are for the purpose of illustrating a preferred embodiment of the invention only and not for the purpose of limiting the same, there is shown in FIG. 1 in a general, schematic block form a gas fired industrial heat treat furnace 10. This furnace is conventional and for the purposes of discussion has a vestibule or charging chamber 12 into which work indicated by phantom lines designated by reference numeral 13 is placed. Vestibule 12 is purged as conventionally known and the work transferred into a heat treat chamber 15 wherein the work is heated by gas fired burners 16 only one of which is shown. After the work is heat treated to its heat treating temperature it is then cycled back to vestibule 12 and transferred by a conventional elevator arrangement (not shown) into a quench tank 18. Quench tank 18 has a liquid bath shown by reference numeral 19 into which work 13 is placed for quenching. The bath or quenchant 19 can comprise water, oil or liquid salts.

As is well known to those skilled in the art when the hot work 13 is placed in bath 19 the heat from work 13 is given off to the quenchant 19 in quench tank 18 raising the temperature of quenchant 19. The immersion cooler or heat exchanger 20 of the present invention is placed in quenchant 19 and functions as a heat sink to absorb heat from quenchant 19 which as noted is given off by work 13. As used herein, the term "immersion cooler" and "heat exchanger" are used interchangeably and for all intents and purposes are the same. However, it is intended that "cooler" designates the function of the device of the present invention acting as a heat sink whereas "heat exchanger" designates the function of the device of the present invention acting to impart heat from a gaseous medium to something else i.e., gas, liquid or solid.

In accordance with the schematic shown in FIG. 1, a fan 22 in a fan chamber 23 draws ambient air into fan chamber 23 where it is compressed under pressure and developed as a wind mass within fan chamber 23 which wind mass is at ambient temperature. The wind mass leaves fan chamber 23 through cooling line 25 into heat exchanger 20 where is it heated by the heat from bath 19 and exits heat exchanger 20 as a heated wind mass through exit line 26 where it is ported out of quench tank 18 to a duct or stack (not shown). The present invention can also operate as a gas-to-gas heat exchanger 20 and an application is shown in FIG. 1 where heat exchanger 20 preheats combustion air ported into gas fired burner 16. In FIG. 1, hot furnace atmosphere within heat treat chamber 15 is drawn or exhausted off from heat treat chamber 15 through exit line 28 where it is inputted into a heat exchanger housing 30 and cooled and exits from heat exchanger housing 30 through exhaust line 29. Heat exchanger 20, as shown, is positioned within heat exchanger housing 30. A combustion air blower 31 is provided for developing within heat exchanger 20 a wind mass of combustion air entering at ambient air temperature which is heated by heat exchanger 20 and once heated leaves as preheated combustion air through combustion air line 33 to gas fired burner 16. A pressured source of gas 34 is also metered through gas line 36 into gas fired burner 16. All gas flows are regulated by valves such as indicated schematically at 38 which in turn are under the control of a microprocessor master controller for regulating the entire process. By appropriate ducting the schematic of FIG. 1 can be easily modified so that only one blower or fan can be used. The purpose of FIG. 1, however, is to simply show the device of the present invention functioning as a gas-to-gas and gas-to-liquid heat exchanger on an industrial heat treat furnace 10. Other piping arrangements and other heat exchanger applications will suggest themselves to those skilled in the art.

Figure 2:
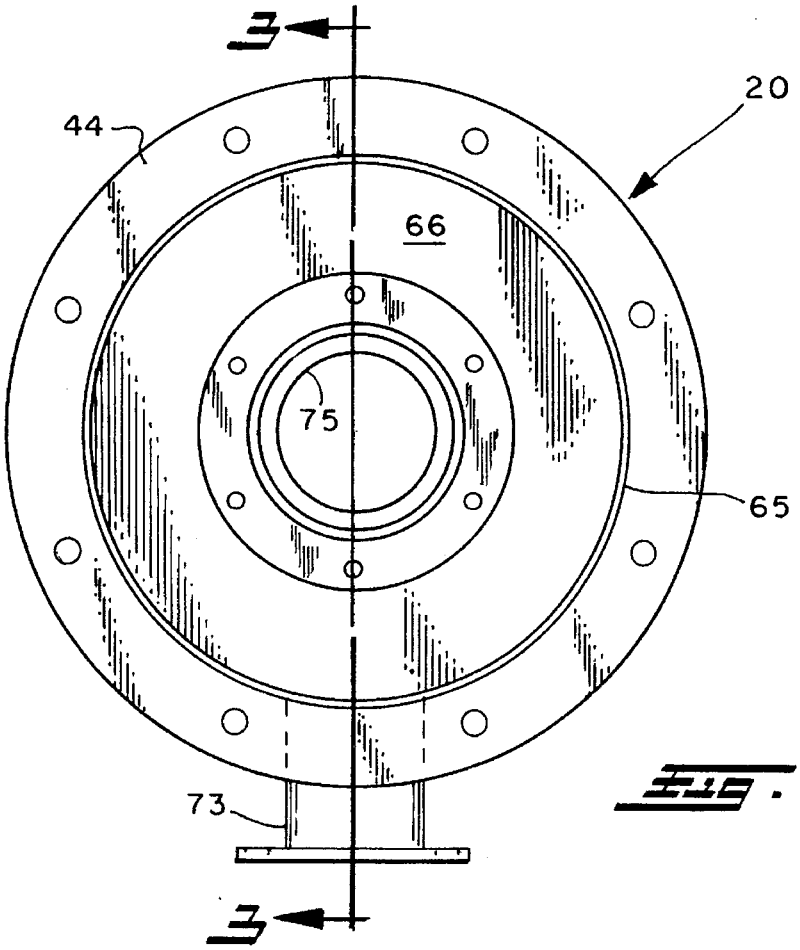
FIG. 2 is a front, end view of the immersion cooler of the present invention.

Referring now to FIGS. 2 and 3 there is shown heat exchanger 20 which includes a thin walled cylindrical heat transfer tube 40. In the preferred embodiment and for the quench tank immersion cooler application, heat transfer tube 40 has a length of about 3 to 6 feet and a wall thickness of about ¼" and is constructed of 304 stainless steel. Heat transfer tube 40 has a closed axial end 41 and an open axial end at 42 which is welded in a gas-tight manner to an annular manifold plate or collar 44. Collar 44 has a circular, central exhaust tube opening 45 and a plurality of circular first distributor tube openings 46 which are spaced in equal circumferential increments about an imaginary circle best shown by phantom line 48 in FIGS. 4 and 5. Central opening 45 and imaginary circle 48 are of course centrally positioned or concentric with centerline 50 of heat exchanger 20. Annular manifold collar 44 is relatively thick and has a plurality of mounting holes for mounting heat exchanger 20 in quench tank 18, etc.

Fitted tightly within each distributor tube opening 46 is a longitudinally extending distributor tube 52. Each distributor tube 52 has a closed axial end 53 while its other axial end 54 is open and adjacent but spaced from manifold collar 44. Closed axial end 53 can be closed by welding or crimping, etc. Each distributor tube 52 has a plurality of orifices 56, which preferably are circular openings, which open or face or confront the interior wall (i.e. the I.D.) of heat transfer tube 40. As is well known by my prior patents, when a pressurized wind mass is inputted in the open axial end 54 of distributor tubes 52 the wind mass will exit distributor tubes 52 through orifices 56 as the wind mass travels down the length of the tube, being dead-ended by closed axial end 53. When wind mass leaves each orifice 56, it travels as a free-standing, right angle high speed jet with velocities as high as 15,000 ft/min and impacts thin wall heat transfer tube 40. This jet impingement increases dramatically the convective heat transfer between the cold (or hot, as the case may be) wind mass within distributor tube 52 and the hot (or cold, as the case may be) heat transfer tube 40. Heat transfer rates as high as 50 Btu/hr-° F. are possible. Reference should be had to my Background Patents for a further explanation of the heat transfer, if desired.

Figure 5:
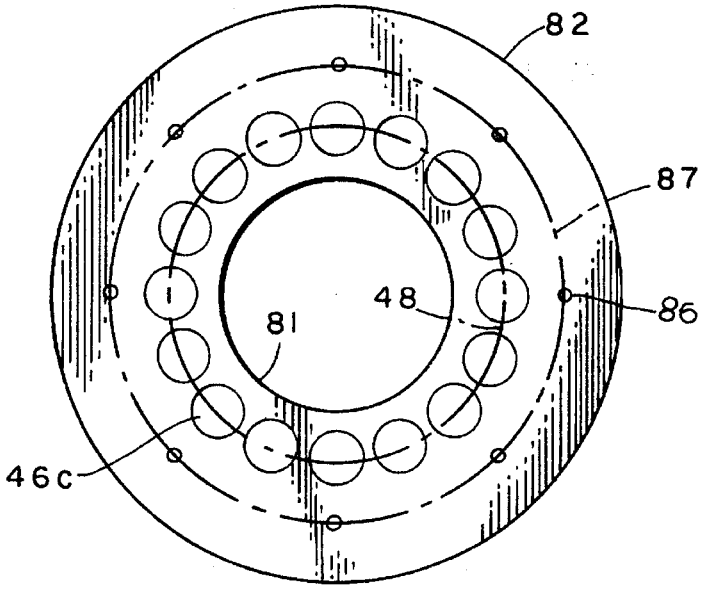
FIG. 5 is a cross sectioned view of the manifold plate used in the immersion cooler of the present invention taken along lines 5—5 of FIG. 3.
Figures 4, 5:
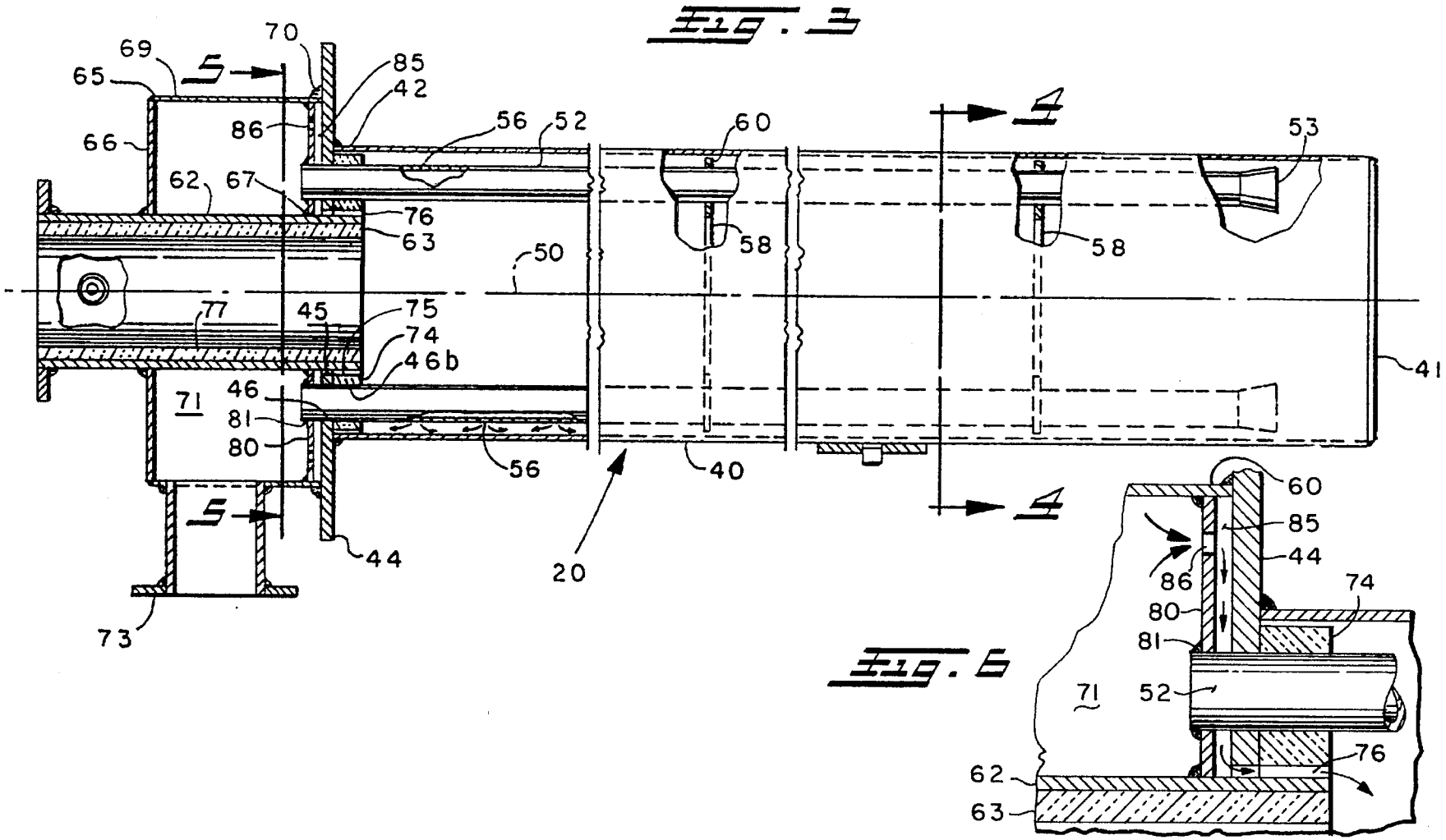
FIG. 4 is a cross-sectional view of a portion of the immersion cooler of the present invention taken along lines 4—4 of FIG. 3.
Figure 4:
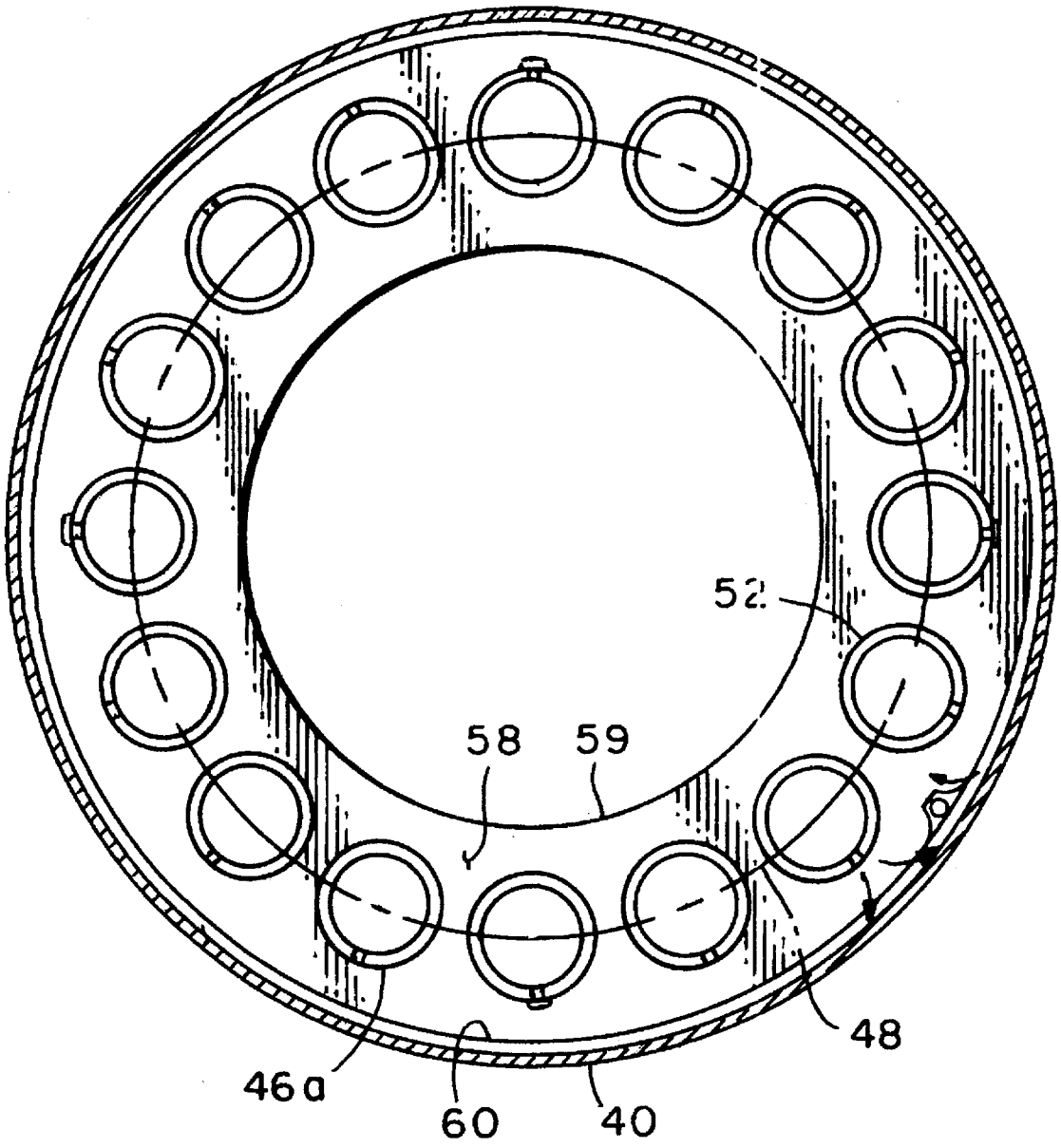

In the preferred embodiment distributor tubes 52 are thin walled (11 gauge) high temperature resistant steel (for instance RA 309 or 330) having an O.D. (outside diameter) of about 1¼" with orifice diameter holes of about 0.052" spaced at equal longitudinal increments of about 2". As best shown in FIGS. 4 and 5, in the preferred embodiment, there are 16 distributor tubes circumferentially spaced at equal increments. Those skilled in the art will recognize that the geometric relationship between the diameter of distributor tubes 52, the diameter of heat transfer tube 40, the diameter of imaginary circle 48 (and thus the distance between orifice 56 and heat transfer tube I.D.), the size of the opening of orifice 56 and the spacing of orifices 56 and also any variation of orifice diameter 56 relative to its longitudinal spacing along each distributor tube 52 (although in the preferred embodiment, the diameter of all orifices 56 is constant) are all factors which must be considered in the design of any heat exchanger 20 to achieve desired heat transfer co-efficients. Surprisingly, the design calculations will show a relatively narrow range of dimensions for optimum performance of any immersion cooler 20. Thus the dimensions specified for heat exchanger 20 of the preferred embodiment achieve optimum heat transfer co-efficients.

It is recognized that where there is a bundle or cluster of distributor tubes 52 and where their length is long, distributor tubes 52 will thermally expand and contract and for long length applications can radially move such that the distance between orifice 56 and the I.D. (inside diameter) of heat transfer tube 40 could change with an adverse effect on the heat transfer exchange with heat transfer tube 40 resulting in hot and cold spots. Note also that distributor tubes 52 have a closed end 53 which are free and are not attached to closed end 41 of heat transfer tube 40 because of the different thermal expansion rates which occur in distributor tubes 52 and heat transfer tube 40. Thus to simply anchor distribution tubes 52 at their closed end 53 is not acceptable. Accordingly, a plurality of internal tube support rings 58 are provided. In the preferred embodiment, tube support rings 58 are longitudinally spaced at 30" increments. Each tube support ring has an annular central opening 59 about the size of central tube opening 54 in manifold collar 44. Tube support ring 58 has a radially outer edge 60 defined by the outside diameter of tube support ring 58. Outer edge 60 is closely adjacent the inside diameter of heat transfer tube 40 such that an annular space of about ⅛" exists in the preferred embodiment between tube support ring 58 and heat transfer tube 40. Also, tube support ring 58 has a plurality of second distributor tube openings designated as **46*a* through which distributor tubes 52 extend. The diameter of second distributor tube openings 46*a* could be slightly larger than that of distributor tube openings 46 formed in manifold collar 44. Preferably, however, distributor tube openings 46*a* are approximately the same diameter as the outside diameter of distributor tubes 52. It can be readily seen that the tube support ring 58 contains a support for each distributor tube 52 and permits only limited movement of distributor tubes 52 as a bundle or as a mass within heat transfer tube 40** to maintain the geometry of the orifice arrangement so that the wind mass jet streams can operate efficiently.

Extending longitudinally from manifold collar 44 in a direction opposite to that from which distributor tubes 52 extend is a cylindrical exhaust tube 62. For reasons which will subsequently be clear, the outside diameter of exhaust tube 62 is sized to be slightly less than the diameter of exhaust tube central opening 45 formed in annular manifold collar so that an annular collar space 63 exists between exhaust tube 62 and manifold collar 44. In the preferred embodiment collar space 63 has a radial distance of about ⅛".

Secured in a gas-tight manner (as by gas-tight welds) to exhaust tube 62 and manifold collar 44 is a manifold housing 65. Manifold housing 65 has a front end portion 66 welded as at 67 to exhaust tube 62 and a cylindrical body portion 69 extending from front end portion 66 and terminating at manifold collar 44 whereat cylindrical portion 69 is welded as at 70. Front end portion 66 and cylindrical portion 69 thus define a sealed manifold chamber 71.

In fluid communication with manifold chamber 71 is an inlet 73 which, for the immersion cooling application receives ambient air. As thus far described, the gaseous coolant medium arrives via inlet 73 into manifold chamber 71 and exits therefrom through distributor tubes 52 which impinge against heat transfer tube 40 and after heat transfer contact therewith, the "spent" cooling gas is collected through the central part of heat transfer tube 40 and exits heat exchanger 20 through exhaust tube 62. The structure as thus far described is an integral gas-tight, welded fabrication and it should be clear that on the heat transfer tube side of manifold collar 44 is a gaseous medium at one temperature while a gaseous medium at an entirely different temperature exists within manifold chamber 71. Thermal expansion and contraction at different rates will thus occur in the arrangement as described thus far.

It is a specific feature of the invention to provide for thermal expansion and contraction without the necessity of having any moving seals or components, spring biased expansion joints, water cooling jackets, etc. This is accomplished in the present invention by providing a thermal insulating, annular fibre ring 74 having a central opening 75 and a plurality of third distributor tube openings **46*b*. Fibre annular ring 74 receives distributor tubes 52 and is in contact with that side of manifold collar 44 facing heat transfer tube 40. Also provided is a thermal ceramic insulating sleeve 77 fitted within exhaust tube 62. It should also be noted that the radial inner edge of fibre annular ring 74 is spaced slightly outward from the exhaust tube 62 to define an annular insulating ring space 76** having a radial distance of about ⅛".

Referring now to FIGS. 2 and 5 a manifold plate 80 is provided closely adjacent but slightly spaced from manifold collar 44 and within manifold chamber 71. Manifold plate 80 has an annular central opening 81 which is the same diameter as the outside diameter of exhaust tube 62 and, in fact, manifold plate 80 is welded gas-tight to the O.D. of exhaust tube 62. Manifold plate 80 has an outer edge 82 which is also shown welded gas-tight as at 81 to cylindrical portion 69 of manifold housing 65. Manifold plate 80 also has a plurality of fourth distributor tube openings **46*c* spaced at equal increments about imaginary circle 48 and, as shown in FIG. 2, receives the open axial end 54 of distributor tubes 52 which are welded gas-tight thereto and function as a support for distributor tubes 52**.

As thus far defined, relatively cold manifold plate 80 which supports distributor tubes 52 is shielded from the heat of heat transfer tube 40 by collar 44 and insulating ring 74 and heat transfer tube 40 is similarly shielded from the relatively cold air in manifold chamber 71 by manifold plate 80, collar 44 and insulating ring 74. This structural arrangement is one of the underpinnings of the invention. In addition, insulating sleeve 77 serves to insulate manifold plate 80 and collar 44 from the heat of the hot air exiting from exhaust tube 62.

As thus defined, between manifold collar 44 and manifold plate 80 is an annular space which is defined as a cooling chamber or cooling space 85. Fluid communication between manifold chamber 71 and cooling space 85 is provided by means of a plurality of bleed orifices 86. As best shown in FIG. 5 there are eight (8) bleed orifices in the preferred embodiment spaced at equal circumferential increments about an imaginary second circle 87 which is larger than internal diameter 48. Bleed orifices 86 allow the incoming gaseous medium (i.e. air at ambient temperature) within manifold chamber 71 which is pressurized into a wind mass to flow through bleed orifices 86 into cooling space 85. A bleed leakage path is provided between cooling space 85 and exhaust tube 62 to permit the gaseous medium to leak or bleed from cooling space 85 to the inside of heat transfer tube 40 and then through exhaust tube 62. This leakage path is the small annular collar space 63 which continues through the small annular insulating ring 76. The actual flow through cooling space 85 is, of course, dependent upon the size of bleed orifices 86 (⅛" in the preferred embodiment) and the size of the annular spaces 63, 76 as well as the pressure developed by the combustion air blower 22 and the residual pressure in the spent wind gas jet streams within heat transfer tube 40. In the preferred embodiment, the flow of the gaseous medium which functions as a coolant is about 5% of the total flow of the inlet gas within manifold chamber 71 so that 95% of the gas flows through distributor tubes 52. Significantly, flow of the gas through bleed chamber 85 is acting to reduce the severity of the temperature gradient through manifold collar 44. This cooling, by itself and in combination with the shielding arrangement provided by insulating ring 74, manifold collar 44 and manifold plate 80 permits the entire heat exchanger 20 to stay sealed despite the fact that heat transfer tube 40 is at a high temperature while distributor tubes 52 are at low temperatures (or vise-versa). Furthermore, bleed orifices 86 in the preferred embodiment are simply allowing a flow of the cooling gas into and through cooling space 85. However, it is within the scope of the present invention to vary the dimensions of cooling space 85 so that bleed orifices act as jets to effect jet impingement with manifold collar 44 to maintain cool collar temperature. In such instance the "lost" bleed gas may rise to a higher value of the total flow, say 10%, but it would not detrimentally affect the overall efficiency of heat exchanger 20.

The invention has been described with reference to a preferred embodiment. Alterations and modifications will suggest themselves to those skilled in the art upon reading and understanding the specifications set forth above. For one particular example, the seal arrangement discussed is not necessarily limited to a heat exchanger or an immersion cooler application. For example, it could be used to even seal the heat treat chamber of an industrial heat treat furnace. In such an application the manifold chamber 71 would receive hot products of combustion from gas fired burners which would travel through radiant-type heat tubes dispersed within the heat treat chamber to heat the work and the cooler furnace atmosphere gases would be returned or vented to stack through exhaust tube 62. In such an arrangement, the distributor tubes could assume almost any type of work surrounding configuration desired with specific orifice patterns so as to develop a specialized jet impingement pattern about the work. Again, the chamber to exhaust stack passage would be through manifold collar 44 and the entire arrangement would then be a unitary weldment which would provide a sealable arrangement that would compensate for temperature deviations between the temperature of the gaseous medium flowing into the furnace and the temperature of the gaseous medium flowing out of the furnace. It is intended to include all such modifications and alterations insofar as they come within the scope of the present invention.

Having thus described the invention, it is now claimed:

1. A heat exchanger using cold pressurized air to cool gases and liquids comprising:

a. a cylindrical heat transfer tube having a closed end and an open end;

b. a manifold secured gas tight to said open end of said heat transfer tube, said manifold having an annular collar adjacent said open end, an annular manifold plate parallel and adjacent to said collar to define an annular cooling space therebetween and a closed manifold housing secured to said collar and surrounding said manifold plate; said collar and said manifold plate, each, having a plurality of aligned distributor tube openings;

c. a plurality of small diameter distributor tubes extending through said tube openings and being gas tight connected to said manifold plate, each tube having orifice openings along its length directed radially outwardly so as to face the interior of said heat transfer tube;

d. an insulating annular ring within said heat transfer tube and adjacent said collar and having a plurality of aligned distributor tube openings so that said manifold plate is protected from direct exposure to heat from within said heat transfer tube by said insulating ring and said collar;

e. said manifold plate having multiple orifices extending therethrough for impinging cold air from said manifold housing against said collar and within said cooling space for cooling said collar;

f. an exhaust tube extending through the central openings of said insulating ring, said collar, and said manifold plate for exhausting heated air from said heat transfer tube; the central openings of said collar and said ring is larger than said exhaust tube to define a leakage path therebetween for leaking air from said cooling space past said insulating ring into the interior of said heat transfer tube; and g. an insulating sleeve secured to said exhaust tube for insulating said collar and said manifold plate from heated air exhausted through said exhaust tube from said heat transfer tube.

2. The heat exchanger of claim 1 further including at least one annular tube support plate spaced at a longitudinal distance within said heat transfer tube, said tube support plate having an inside diameter approximately equal to that of said exhaust tube and an outside diameter slightly less than the inside diameter of said heat transfer tube, said tube support plate further including a plurality of fourth distributor tube openings aligned with said collar distributor tube openings for receiving said distributor tubes whereby said tube support plate's outer edge restrains movement of said distributor tube during operation of said heat exchanger.

3. The heat exchanger of claim 2 wherein said tubular openings in said insulating ring, said collar and said manifold plate are located with the center of each tubular opening circumferentially spaced from one another on an imaginary circle which is concentric with said exhaust tube, said multiple orifices spaced radially outwardly from said imaginary circle to insure cooling of said collar.

4. The heat exchange of claim 3 wherein said insulating ring has a central opening larger than said insulating sleeve to define an annular space therebetween said annular space forming part of said leakage path.

5. A gas immersion cooler for cooling the liquid contents of a heat treat furnace quench tank comprising:

a. a cylindrical heat transfer robe having a closed axial end and an open axial end;

b. an annular manifold collar secured on one side in a gas tight manner to said heat transfer tube's open end, said collar having a central exhaust opening and a plurality of distributor robe openings, the center of each distributor tube opening located at equal circumferential increments about an imaginary circle concentric with said exhaust opening;

c. a gas exhaust tube longitudinally extending from said exhaust opening and a distributor tube within each tube opening extending longitudinally in the opposite direction from said exhaust tube to be positioned within and closely adjacent the interior of said heat transfer tube, each distributor tube having a plurality of orifices opening to the interior cylindrical surface of said heat transfer tube and spaced at longitudinal increments so that each orifice is adapted to develop a free standing gas jet impinging the interior surface of said heat transfer tube;

d. a manifold housing secured in a gas tight manner to said exhaust tube on the opposite side of said collar from that which said heat transfer tube is affixed, said manifold housing having an air inlet in fluid communication with said distributor tubes;

e. fan means outside said quench tank for developing a pressurized wind mass at ambient temperature; inlet conduit means in fluid communication with said fan means and said manifold inlet extending into said quench tank for providing said pressurized wind mass to said distributor tubes and outlet conduit means in fluid communication with said exhaust tube extending outside said quench tank for exhausting said wind mass from said cooler after it has impacted the interior of said heat transfer tube.

6. The immersion cooler of claim 5 further including an annular manifold plate within said manifold housing spaced closely adjacent to said collar side from which said exhaust tube extends, said manifold plate having a central annular opening receiving said exhaust tube and welded gas tight thereto, said manifold plate having a plurality of second distributor tube openings aligned with said distributor tube openings in said collar and secured gas tight to said distributor tubes; and a plurality of bleed orifices extending through said manifold plate adapted to permit a portion of said wind mass to pass therethrough and impinge said collar for cooling same, said central exhaust opening in said collar slightly larger than said exhaust tube so that said wind mass can flow therethrough into said heat transfer tube whereby said manifold plate is shielded from heat from said heat transfer tube by said collar which is cooled by coolant from within said manifold housing.

7. The immersion cooler of claim 6 wherein said manifold housing includes a circular end plate portion having a central opening through which said exhaust tube extends in a secured, gas-tight manner and a cylindrical portion longitudinally extending from said end plate portion to said collar whereat said cylindrical portion is affixed in a gas-tight manner, said manifold plate having an outer edge secured in a gas-tight manner to the interior of said cylindrical portion to define a cooling, space within said manifold housing between said manifold plate and said collar.

8. The immersion cooler of claim 6 further including a thermal, ceramic riser sleeve within the interior of said exhaust tube, and an insulating ring within said heat transfer tube adjacent said collar, said insulating ring having a central opening slightly larger than said sleeve and a plurality of third distributor tube openings aligned with said second distributor tube openings for receiving said distributor tubes whereby said insulating ring and said collar shield said manifold plate from heat within said heat transfer tube while said insulating sleeve shields said manifold plate and said collar from heated coolant exhausted from said heat transfer tube.

9. The immersion cooler of claim 5 further including at least one annular tube support plate spaced at a longitudinal distance within said heat transfer tube, said tube support plate having an inside diameter approximately equal to that of said exhaust tube and an outside diameter slightly less than the inside diameter of said heat transfer tube, said tube support plate further including a plurality of fourth distributor tube openings aligned with said collar distributor tube openings for receiving said distributor tubes whereby said tube support plate's outer edge restrains movement of said distributor tube during operation of said immersion cooler to maintain radial spacing between said distributor tube's orifices and the interior of said heat transfer tube.

10. A thermal seal arrangement in combination with a gas heat exchanger which includes a plurality of elongated distributor tubes having a plurality of orifices spaced along the length thereof for discharging jet streams of a gaseous heat exchange medium in convective heat transfer contact with a heat transfer surface, said distributor tubes affixed to an annular manifold collar having a central exhaust opening, said seal arrangement comprising:

a manifold housing affixed in a gas tight manner to said manifold collar on the side opposite from that which said distributor tubes extend and having an inlet opening formed therein;

an exhaust tube slightly less in diameter than said collar's central opening extending through said manifold housing and sealed in a gas tight manner to said housing to define between said manifold housing and said exhaust tube a sealed manifold chamber, said manifold chamber in fluid communication with the inlets of said distributor tubes mounted to said manifold collar and a manifold plate within said manifold chamber, said manifold plate and said collar having a plurality of openings through which said distributor tubes extend, said distributor tubes gas tight secured to said manifold plate; said manifold plate secured at its outer edge to said manifold housing and at its inner edge to said exhaust tube to define a cooling space within said manifold chamber extending between said manifold plate and said manifold collar, said manifold plate having a plurality of bleed orifices extending therethrough for permitting a small portion of said gaseous medium in said manifold housing to impinge said manifold collar and subsequently pass through the opening between said manifold collar and said exhaust tube prior to being exhausted through said exhaust tube to maintain said manifold plate at even thermal temperatures while shielding said manifold plate from heat.

11. The seal arrangement of claim 10 further including an insulating ring adjacent said collar opposite said manifold plate for shielding said collar from heat, said insulating ring having a central opening larger than and receiving said exhaust tube, said small portion of said gaseous medium exhausted through the space between said insulation ring and said exhaust tube.

12. The seal arrangement of claim 11 further including an insulating sleeve secured to said exhaust tube for insulating said collar and said manifold plate from heat within said exhaust tube.

13. The seal arrangement of claim 12 wherein said gaseous medium is air at ambient temperatures and said portion of said gaseous medium is no more than about 5% by mass flow volume of said gaseous medium.

* * * * *